United States Patent [19]

Murray et al.

[11] Patent Number: 4,458,739

[45] Date of Patent: Jul. 10, 1984

[54] INSULATIVE ROLL-UP SHADE SYSTEM

[76] Inventors: John J. Murray, 964 Parkside Ave., Buffalo, N.Y. 14216; Louis E. Wagner, 8 Eltham Dr., Eggertsville, N.Y. 14226

[21] Appl. No.: 411,594

[22] Filed: Aug. 26, 1982

Related U.S. Application Data

[63] Continuation-in-part of Ser. No. 110,486, Jan. 8, 1980.

[51] Int. Cl.[3] ..... E06B 9/08; E06B 9/17

[52] U.S. Cl. ..... 160/23 R; 160/269

[58] Field of Search ..... 160/23 C, 23 R, 269, 160/26

[56] References Cited

U.S. PATENT DOCUMENTS

| | | | |
|---|---|---|---|
| 2,548,041 | 4/1951 | Morse | 160/23 R |
| 3,292,685 | 12/1966 | Clark | 160/26 |
| 3,939,620 | 2/1976 | Bero | 52/716 |
| 3,990,635 | 11/1976 | Restle et al. | 160/23 C |
| 4,220,189 | 9/1980 | Marquez | 160/23 R |

*Primary Examiner*—Peter M. Caun
*Assistant Examiner*—Cherney S. Lieberman

[57] ABSTRACT

An insulative window shade assembly of the roll-up type for windows or like openings comprises a flexible sheet of shade material essentially of the size in area of the window or other opening to be insulated. The flexible sheet of material in its inoperative position is contained in a header or casing mounted at the top of the opening and extending across the width of the opening. The casing contains a spring-actuated roller upon which the sheet of shade material is wound with the leading edge protruding through a longitudinal slot or opening in the casing. The system further provides two side guides or channels mounted at the sides of the window or opening, and in which the channels contain a pile fabric to seal the sides of the flexible sheet when unrolled to the operative or insulative position. The leading edge of the sheet of flexible material is provided with a bar or rigid member constructed with means for securing it in a co-acting gripping device at the base of the window or opening whereby the shade is secured and sealed at the base or bottom of the window. The gripping means is desirably adjustable so that it can be secured on a horizontal or vertical supporting surface. The system is featured by side guides which are of flexible or hingeable nature or are readily separable into front and back portions whereby they can be opened over at least the lower portion of their lengths to permit a free downward pull upon the sheet so as to activate the spring mechanism of the roller to readily wind up the shade, when desired.

1 Claim, 8 Drawing Figures

INSULATIVE ROLL-UP SHADE SYSTEM

This application is a continuation-in-part application of U.S. Pat. Application Ser. No. 110,486 filed Jan. 8, 1980.

This invention relates to an insulative shade assembly or system of the roll-up type adapted for mounting in a window or other opening or aperture to be insulated to prevent excessive transfer and loss of thermal energy through the window or opening. Where reference herein is made to windows it is intended to include by that term other apertures or openings where excessive heat losses can occur by transmissions of thermal energy through the opening or aperture.

Attempts to reduce such excessive heat losses by the use of window drapes and other coverings are very unsatisfactory in accomplishing their purpose, and furthermore such drapes and other coverings interfere with the usually desirable transmission of light.

Window shades of the roll-up type have been proposed for insulative purposes, but in most cases they have been ineffective in serving their purpose because most proposed shade structures have been more or less open at the sides and/or at the bottom of the window opening so as to allow relatively free passage of air to and from the space between the shade and the window sash.

Other known shade structures of the roll-up type in the prior art have been proposed in which means have been incorporated for sealing the shade at the bottom and sides to prevent or lessen such air seepage. However, they have been found unsatisfactory for one or more reasons. Some have been either inoperative or operative only with extreme difficulty, and others have involved casings or headings, side guide members and other structural elements so expensive to fabricate or difficult to assemble and mount upon the window opening as to render them commercially uneconomical, cumbersome or otherwise unattractive for use.

It is an object of the present invention to provide a window shade system of the roll-up type that is relatively simple and inexpensive to fabricate.

It is a further object to provide a roll-up window shade system that is easily mountable upon a window and easy to operate from a wound-up to an unwound or operable position, and vice versa.

It is still a further object to provide a roll-up window shade system that is attractive in appearance and does not detract appreciably from the ability of the window to transmit light.

It is also an object to provide a roll-up window shade system that effectively closes or seals the space between the conventional window sash and the shade whereby air seepage therefrom is minimized and the maximum insulative value is obtained.

These and other objects and advantages will become apparent as the system is herein described and can be seen from the drawings.

In accordance with the invention, an insulative window shade assembly or system of the roll-up type for windows and like openings is provided which comprises a flexible sheet of material essentially the same or slightly larger in area than the area of the window or other opening to be insulated. The sheet of flexible shade material can be a clear or tinted plain sheet of plastic material where high transmission of light through the shade is desired, or it can be a closely woven fabric where high light transmission is not required and a decorative effect is desired. The flexible sheet of shade material in its inoperative position is contained in a header or casing mounted in use at the top of the window and extending across and slightly beyond the width of the window. The casing contains a spring-actuated roller upon which the sheet of shade material is wound with the leading edge protruding through a longitudinal slot or opening in the casing.

The system further comprises two side guides or channels mounted at the sides of the window, which channels contain a pile fabric element to seal the sides of the flexible sheet when it is unrolled to the operative or insulating position. The leading edge of the sheet of flexible shade material is provided with a bar or rigid member extending across the width of the sheet and equipped with means for securing it in a co-acting gripping device at the base of the opening whereby the shade is secured and sealed at the bottom. The gripping means is desirably adjustable so that the bar can be attached on a horizontal or vertical supporting surface.

The system is featured by side guides which are flexible or of hinged structure or formed of readily separable, interlocking front and back portions whereby they can be opened over all or at least the lower portion of their length to permit a free downward pull upon the sheet so as to activate the spring mechanism of the roller to readily wind up the shade, when desired.

Reference is now made to the accompanying drawings which illustrate preferred embodiments of the invention, and which depict the various features desirably embodied in the present shade system, and in which FIG. 1 is a front perspective view of a window shade assembly as installed in a window opening with the shade pulled down to an operative position;

Figure 1:
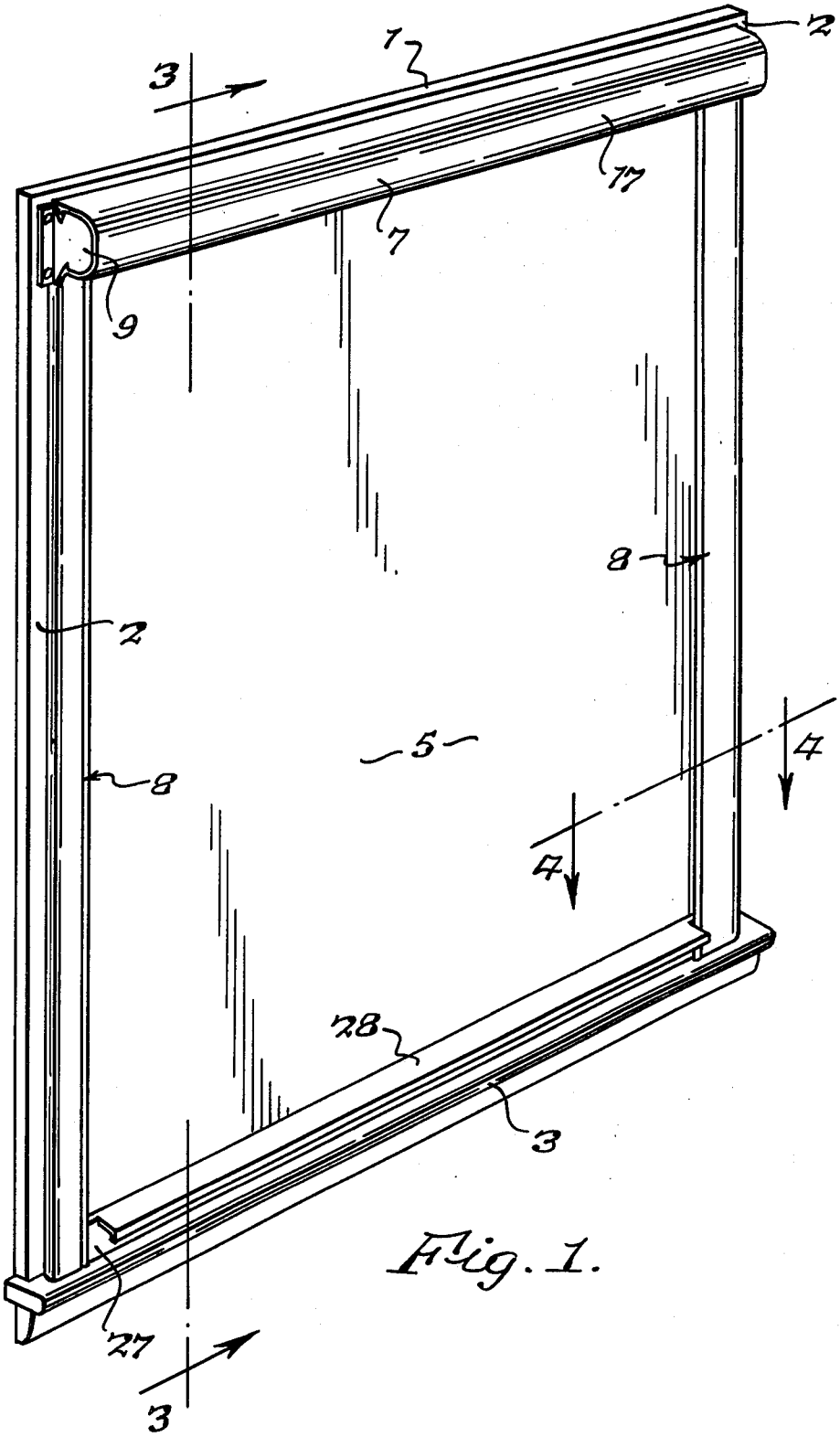
Figure 2:
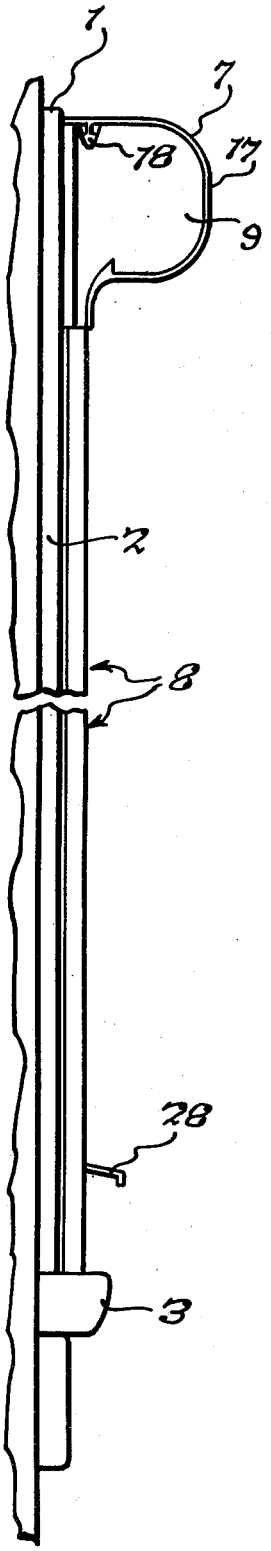
FIG. 2 is a vertical side elevational view of the shade assembly shown in FIG. 1.

Referring further to the drawings, a window is illustrated, the frame of which includes a head or top frame 1, side jambs 2 and a sill 3. The conventional sash in the window depicted is in one piece as, for example, in a picture window, and is made of glass. The herein described type of auxiliary window construction, it is to be understood, is for illustrative purposes only, and the principles of the present invention can be applied to other types of window structures, such as by way of example, windows of the double action type having sliding upper and lower sashes, or casement windows, or in fact doorways or other apertures or openings presenting areas of potentially excessive loss of thermal energy.

In order to effectively reduce the transmission of thermal energy through the window, an insulating shade system of the rollup type constructed in accordance with and embodying the novel principles and unique features of the present invention is installed and can be described as follows;

The sheet of flexible shade material 5 can be a clear or tinted plain sheet of plastic material where high transmission of light through the shade is desired or it can be a closely woven fabric where high light transmission is not required and a decorative effect is desired. The flexible sheet of shade material is essentially equivalent in area to the area of the window opening to be insulated. In other words, the sheet of flexible shade material is slightly longer and wider than the actual window area so as to provide for mounting the upper edge upon a spring-actuated roller 6 in an upper header or casing 7 and wide enough to permit the edges to fit into the side guides 8 mounted on the side jambs 2 of the window frame. A sheet material that has been found highly satisfactory for the purpose is a polycarbonate plastic 7–10 mm. in thickness, such as that sold on the market in roll form by General Electric Company of Schenectady, New York under the trademark "LEXAN". However, the transparent or tinted, polycarbonate plastic sheet material can be somewhat thicker or thinner, and other comparable transparent or tinted, flexible organic plastic sheet materials can be used in place of the polycarbonate material without departing from the principles of the present invention. Also, it is within the scope of the present invention to use, instead of a clear or tinted thermoplastic material, a flexible closely woven, decorative fabric for decorative effect.

The top edge of the sheet 5 of flexible shade material is fastened to a conventional spring-actuated wooden roller 6 approximately one inch in diameter upon which the sheet is wound whereupon the roller with the wound up sheet of material is slightly under 1½ inches in total diameter. The roller 6 carrying the sheet material 5 is mounted in the header or casing 7 by the conventional method of mounting any spring-actuated roller in position by suitable extending end members on the roller fitting into co-acting elements provided on the inside faces of the end caps 9. When so mounted the spring action of the roller 6 permits the plastic sheet 5 to be pulled downward into an operative position by a downward pull upon the leading edge of the sheet.

The header or casing 7 is preferably made of primarily a plastic material and is fastened to the top frame of the window by adhesive, screws or nails (not shown). Although other materials can be used for the casing, plastic material is preferred over wood, metals or other structural materials because it has various advantages, including lightness in weight and structure, ease of fabrication such as by extrusion, decorative attractiveness and lower costs of fabrication.

Figure 3:
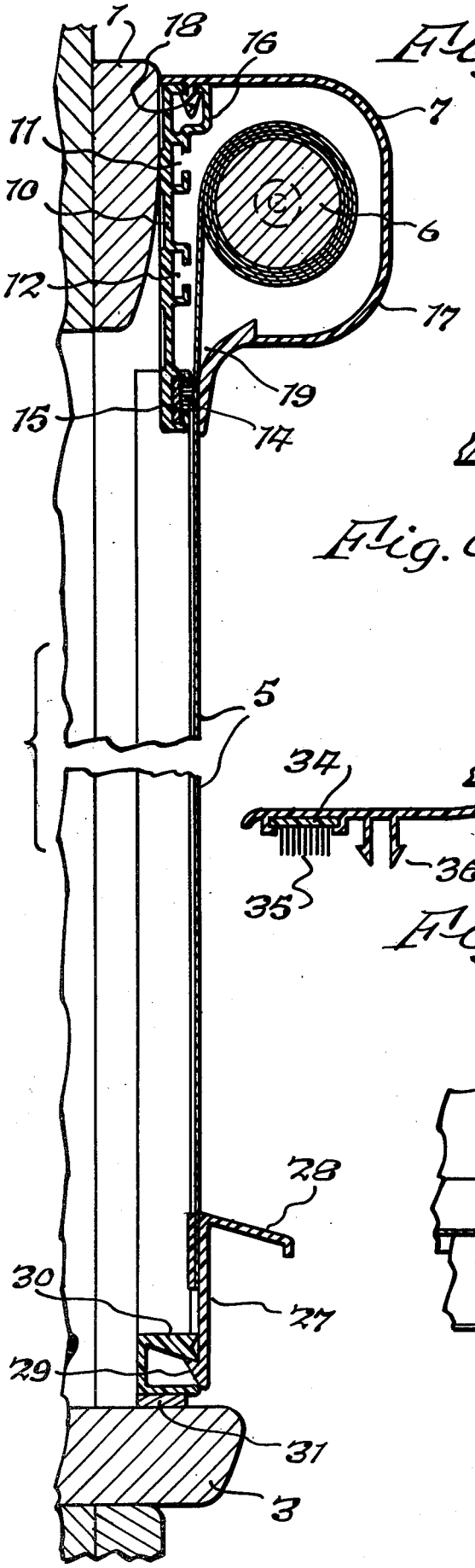
FIG. 3 is a vertical cross-sectional view through the line 3—3 of FIG. 1.

In the particular embodiment of the system shown, with specific reference to FIG. 3 for structural details, the main body of the casing 7 is constructed of a back wall portion 10 that can be adhesively or mechanically secured to the top frame of the window throughout its length which is sufficient to extend from one side of the window opening to the opposite side. Wall portion 10 has molded integrally therewith on the front face two parallel channel members 11 and 12 extending the complete length of the back member into which projections on the inside faces of the end caps 9 of the casing fit to hold the end caps in place. A third channel 14 is integrally molded into the backing, into which a pile fabric sealing member 15 is fitted to form a seal for the flexible shade at the top of the window. Finally an integral projecting pocket member 16 is provided the entire length of the back portion 10 to provide means for snapping and locking the front portion 17 of the casing 7 by means of an interlocking lip member 18 on the front portion 17. When the casing 7 is assembled, a slot 19 is provided with a channel containing a pile fabric lining element 15 which presses against the window shade as it passes through the slot 19 to provide a seal against air leakage. Finally, the two ends of the casing 7 are closed by means of a cap 9 at each end of the main body of the casing.

Figure 4:
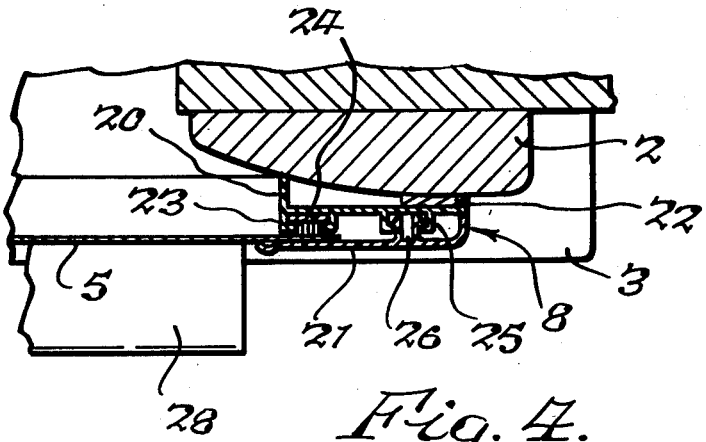
FIG. 4 is a horizontal cross-sectional view through the line 4—4 of FIG. 1.

Referring specifically to FIG. 4, two side guides 8, one on each side of the window opening, are provided. Each side guide extends the full vertical length of the window opening from top to bottom and consists of a back element 20 and front element 21. The back elements 20 are mounted upon the side jambs 2 of the window by an adhesive 22, although they can be secured by nails or screws if desired, so as to be in sealed relationship with the window frame. The back element 20, usually integrally molded by extrusion, along the one edge for the entire length is provided with a channel 23 into which is fitted a pile fabric sealing element 24 from top to bottom. A second and parallel inwardly lipped channel element 25 is provided from top to bottom. The front element or member 21 of each side guide is provided with an interlocking outwardly lipped projection 26 which snaps and fits into the channel 25 to form an interlocking fit so that the front and rear elements 21 and 20 together form a side guide and sealing means for the sides of the window shade.

Figure 5:
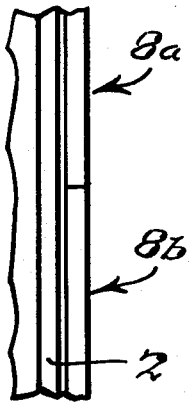
FIG. 5 is a fragmentary side elevational view of the middle fragment only of a modification of the design of FIG. 2, in which the side guide members are divided across their length into upper and lower sections.
Figure 8:
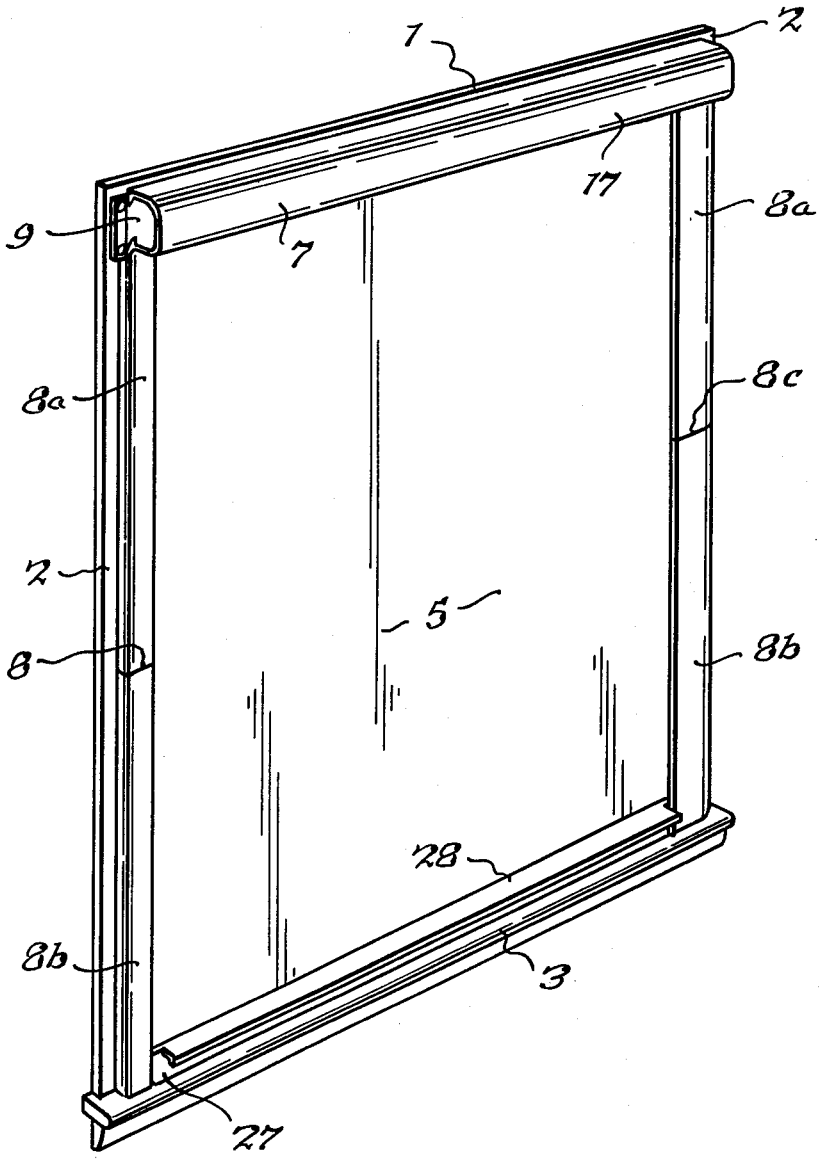
FIG. 8 is a frontal elevational view in perspective of the shade assembly having laterally divided side guide members as shown in fragmentary side elevation in FIG. 5.

Referring to FIGS. 5 and 8, the side guide members at **8*e* can be divided into an upper half 8*a* extending from approximately the mid-point vertically of the window upwardly to the top and a lower half 8*b* extending from approximately the mid-point vertically of the window downwardly to the bottom of the window, thus permitting the side guide to be opened over the lower portion 8*b* only while leaving the upper portion 8*a*** closed.

As shown in FIG. 3, the leading or bottom edge of the shade has secured to it a rigid or semi-rigid bar or strip 27, preferably but not necessarily of an extrusion-molded organic plastic material. The bar or strip 27 is provided with an outwardly projecting gripping element 28 at the top and an inwardly projecting lip element 29 at the bottom, the latter locking into a co-acting member 30 cemented by an adhesive 31 or otherwise secured to the sill 3 of the window.

Figure 6:
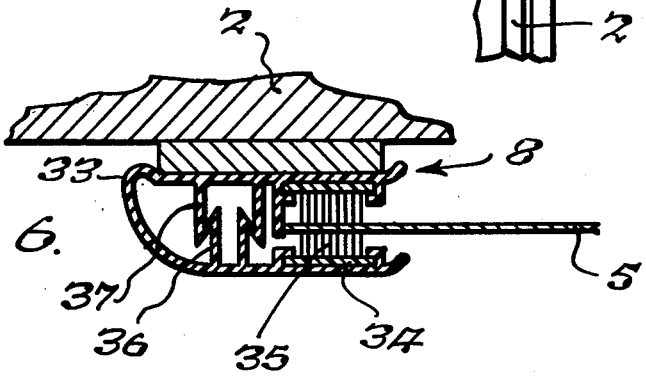
FIG. 6 is a horizontal cross-sectional view similar to that of FIG. 4, but having a modified form of side guide member in closed position.
Figure 7:
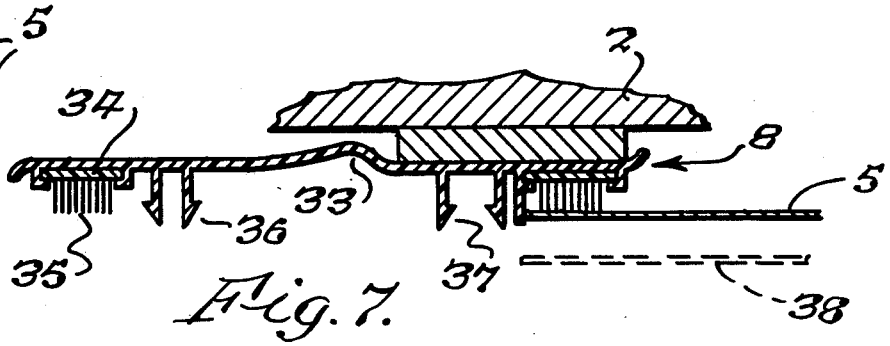
FIG. 7 is a horizontal cross-sectional view similar to that of FIG. 4, showing the same modified form of side guide member shown in FIG. 6, but with the side guide member in open position.

Referring specifically to FIGS. 6 and 7, a modification of the system is shown in which the side guides 8, instead of being composed of two separate portions, front and back, as shown in FIG. 4, are formed of one piece of flexible plastic material, as for example, polypropylene plastic. FIG. 6 depicts one of the side guides which are flexible or hinged in the mid portion 33 laterally when in the closed or fully operable position with the edge of the insulating shade gripped by the pile fabric member 34 and sealed against air leakage. As shown, the two edge portions of the side guides when so folded throughout their length are channel-shaped to receive pile fabric elements 34 which serve to form the air seal. The filaments 35 of the pile fabric elements can be of any suitable material of adequate durability under the conditions of use; one satisfactory material is polypropylene plastic.

A feature of the side guides 8 of FIGS. 6 and 7 is their flexible or hingeable character which permits them to be folded as in FIG. 6 or to be opened as shown in FIG. 7, thus freeing the shade so that it can readily be pulled downward to activate the roller and raise the shade. Optionally, each of the side guide members can be constructed in two parts, an upper part 8*a* and a lower part 8*b*, so that only the lower part 8*b* need be opened to free the shade for movement. Each of the side guides is also provided with a set of male and female co-acting snap-lock clips 36 and 37, respectively, for holding the side guides in closed or folded position. Dotted line 38 in FIG. 7 shows the relative position of the outer side of the side guide when closed.

While definite embodiments of the invention have been herein described and depicted in the drawings, it is to be understood that the invention is not to be restricted thereto, but may be applied to other types of window or door openings, and that other materials of construction than plastic can be used for one or more components of the system without departing from the spirit of the invention. It is further to be understood that many details of construction can be changed without departing from the invention which is not to be limited to the specific detailed embodiments disclosed except insofar as these are claimed.

It is claimed:

1. An assembly for an insulative shade of the roll-up type comprising (a) a sheet of flexible shade material essentially as large in area as the area of the opening to be insulated and having a rigid bar member secured across the width of the leading edge of the sheet of material, (b) an elongated casing of sufficient length to extend across the width of the opening to be insulated and capable of being mounted at the top thereof in sealed relationship thereto, said casing having an elongated slot through which said sheet of flexible material can be passed, (c) a spring-actuated roller mounted within said casing and upon which roller the sheet of flexible material is capable of being wound, (d) two side guide members essentially equivalent in length to the length of the opening to be insulated and mountable along the two vertical sides thereof in sealed relationship thereto, said side guide members being of channel-shaped configuration and longitudinally divided into front and rear portions having a fold edge and an open edge, said portions held together in closed position by co-operating and easily releaseable separable fasteners adjacent the interior of their fold edge, and with pile fabric sealing means on the interior of the side guide members adjacent said open edges from end to end longitudinally and adjacent the side edges of the shade to maintain the shade in non-gripping but air-sealing relationship, the side guide members being divided across their length into upper and lower side guide members whereby when the leading edge of the shade is released, and the lower or upper and lower side guide members are opened, the shade may be moved freely along the length of the window in the usual manner, and (e) means at the bottom of the opening to be insulated and adapted to be releasably engaged to and hold the sheet of flexible material in sealed position along the bottom edge of the opening to be insulated.

* * * * *